US007603960B1

(12) United States Patent
Perry et al.

(10) Patent No.: US 7,603,960 B1
(45) Date of Patent: Oct. 20, 2009

(54) CLEAT CLAMP SYSTEM

(76) Inventors: Heath A. Perry, 321 Shore Dr., East, Oldsmar, FL (US) 34677; Kathryn E. Perry, 602 Franklin Ave., Oldsmar, FL (US) 34677

( * ) Notice: Subject to any disclaimer, the term of this patent is extended or adjusted under 35 U.S.C. 154(b) by 0 days.

(21) Appl. No.: 12/077,572

(22) Filed: Mar. 20, 2008

(51) Int. Cl.
*B63B 17/00* (2006.01)

(52) U.S. Cl. ..... 114/364; 114/218

(58) Field of Classification Search ..... 114/218, 114/343, 363, 364; 43/21.2; 248/514, 515; 292/113
See application file for complete search history.

(56) References Cited

U.S. PATENT DOCUMENTS

| | | | | | |
|---|---|---|---|---|---|
| 2,502,684 | A | * | 4/1950 | Ward | 248/515 |
| 3,304,037 | A | * | 2/1967 | Candela | 248/515 |
| 4,865,169 | A | * | 9/1989 | Rachels et al. | 188/300 |
| 5,018,690 | A | * | 5/1991 | Widmer | 246/428 |
| 5,662,306 | A | * | 9/1997 | Dysarz | 248/514 |

* cited by examiner

*Primary Examiner*—Ed Swinehart

(57) ABSTRACT

A table has a planar top panel. The table has downwardly extending legs. Each leg has an upper end. The upper end of each leg is attached to the top panel. Support hardware is attached to the upper surface of the top panel. A locking assembly is provided. The locking assembly attaches and releases the table with the support hardware to a cleat of a boat.

1 Claim, 4 Drawing Sheets

CLEAT CLAMP SYSTEM

BACKGROUND OF THE INVENTION

Field of the Invention

The present invention relates to a cleat clamp system and more particularly pertains to removably coupling a wide variety of objects to a boat in a safe, reliable, convenient manner.

SUMMARY OF THE INVENTION

In view of the foregoing disadvantages inherent in the known types of coupling systems of known designs and configurations now present in the prior art, the present invention provides an improved cleat clamp system. As such, the general purpose of the present invention, which will be described subsequently in greater detail, is to provide a new and improved cleat clamp system and method which has all the advantages of the prior art and none of the disadvantages.

To attain this, the present invention essentially comprises a cleat clamp system. First provided is a ship. The ship has an upper support surface. The upper support surface is in a horizontal plane. Attached to the support surface is a cleat. The cleat has a cross bar. The cross bar has a central section. The cross bar has end sections. The cross bar has laterally spaced support sections. The support sections are provided between the central and end sections. The cleat also has downwardly extending projections. The upper ends of the downwardly extending projections are formed integrally with the central sections. The lower ends of the downwardly extending projections are shaped to include apertures. Screws are provided. The screws attach the cleat to the upper surface of the boat.

Provided next is a table. The table has a planar top panel. The table has an upper surface. The table has a lower surface. The table is in a rectangular configuration. The table has four downwardly extending legs. Each leg has an upper end. Each leg has a table bolt. The table bolt attaches the leg to the lower surface of the top panel. Each leg is provided in proximity to one corner of the lower surface of the top panel. The table is positioned on the upper surface of the boat. The central section of the cross bar is located between the legs and the ends sections of the cross bar. The central section of the cross bar extends beyond the legs.

Provided next is support hardware. The support hardware is attached to the upper surface of the top panel. The support hardware includes a base plate. The base plate is provided adjacent to one end of the upper surface above two of the legs. The support hardware includes four plate bolts. The plate bolts attach the plate to the top panel. The support hardware further includes a lower plate. The lower plate extends upwardly from the base plate. A horizontal threaded lower aperture is provided perpendicular to the cross bar.

The support hardware also includes a terminal component. The terminal component has a threaded upper end. A fishing pole is provided. The threaded upper end provides for the removable receipt of the fishing pole. The terminal component has an upper plate. The upper plate extends downwardly from the threaded upper end. A horizontal threaded upper aperture is provided perpendicular to the threaded lower aperture.

The support hardware also includes an intermediate element. The intermediate element has an unthreaded lower aperture. The lower aperture is axially aligned with the threaded lower aperture. Mating radial teeth radiate from the lower apertures. The intermediate element has a lower coupling bolt. The intermediate element has a hexagonal recess. The hexagonal recess couples and uncouples the lower plate and intermediate element with the tightening and loosening of the lower coupling bolt. The intermediate element also has an unthreaded upper aperture. The upper aperture is axially aligned with the threaded upper aperture. Mating radial teeth radiate from the upper apertures. The intermediate element also has an upper coupling bolt. The upper coupling bolt couples and uncouples the terminal component and intermediate element with the tightening and loosening of the upper coupling bolt. The upper coupling bolt has a collar with a handle. In this manner the turning of the upper bolt is facilitated.

Provided last is a locking assembly. The locking assembly attaches and releases the table with the support hardware to the cleat and boat. The locking assembly includes an unthreaded hole through the top panel of the table. A J-shaped hook is formed with a lower arcuate section adapted to be releasably positioned beneath the central section of the cross bar of the cleat and an upper threaded section extending upwardly through the hole. A nut threadedly receives the threaded section of the hook. A lever supports the nut and the nut constitutes a pivot point for the lever. The locking assembly also includes a horizontal base plate with an unthreaded aperture for the hook and side plates pivotally supporting the nut. The lever is adapted to pivot the cam in a first direction to raise the nut and hook to a locking orientation with the hook in secure engagement with the cleat. The lever is adapted to pivot the cam in a second direction to lower the nut and hook to an unlocking orientation with the hook spaced from the cleat for separation purposes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cleat clamp system which has all of the advantages of the prior art coupling systems of known designs and configurations and none of the disadvantages.

It is another object of the present invention to provide a new and improved cleat clamp system which may be easily and efficiently manufactured and marketed.

It is further object of the present invention to provide a new and improved cleat clamp system which is of durable and reliable constructions.

An even further object of the present invention is to provide a new and improved cleat clamp system which is susceptible of a low cost of manufacture with regard to both materials and labor, and which accordingly is then susceptible of low prices of sale to the consuming public, thereby making such cleat clamp system economically available to the buying public.

Even still another object of the present invention is to provide a cleat clamp system for removably coupling a wide variety of objects to a boat in a safe, reliable, convenient manner.

Lastly, it is an object of the present invention to provide a new and improved cleat clamp system. A table has a planar top panel. The table has downwardly extending legs. Each leg has an upper end. The upper end of each leg is attached to the top panel. Support hardware is attached to the upper surface of the top panel. A locking assembly is provided. The locking assembly attaches and releases the table with the support hardware to a cleat of a boat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 2:
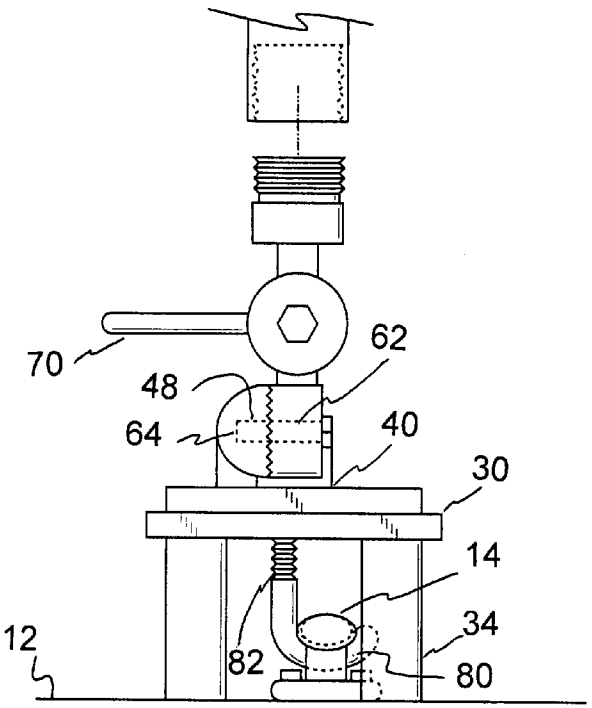
FIG. 2 is a front elevational view of the system shown in FIG. 1.
Figure 1:
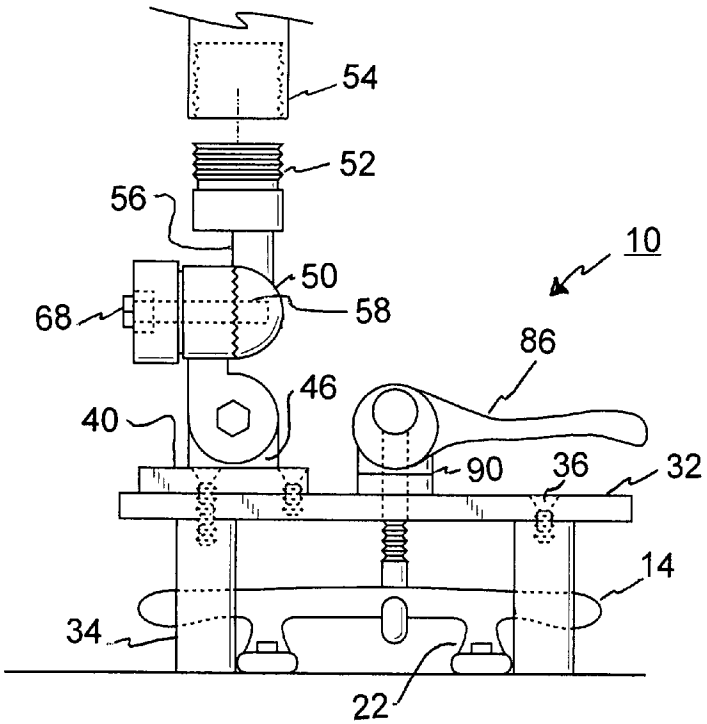
FIG. 1 is a side elevational view of a cleat clamp system constructed in accordance with the principles of the present invention.
Figure 3:
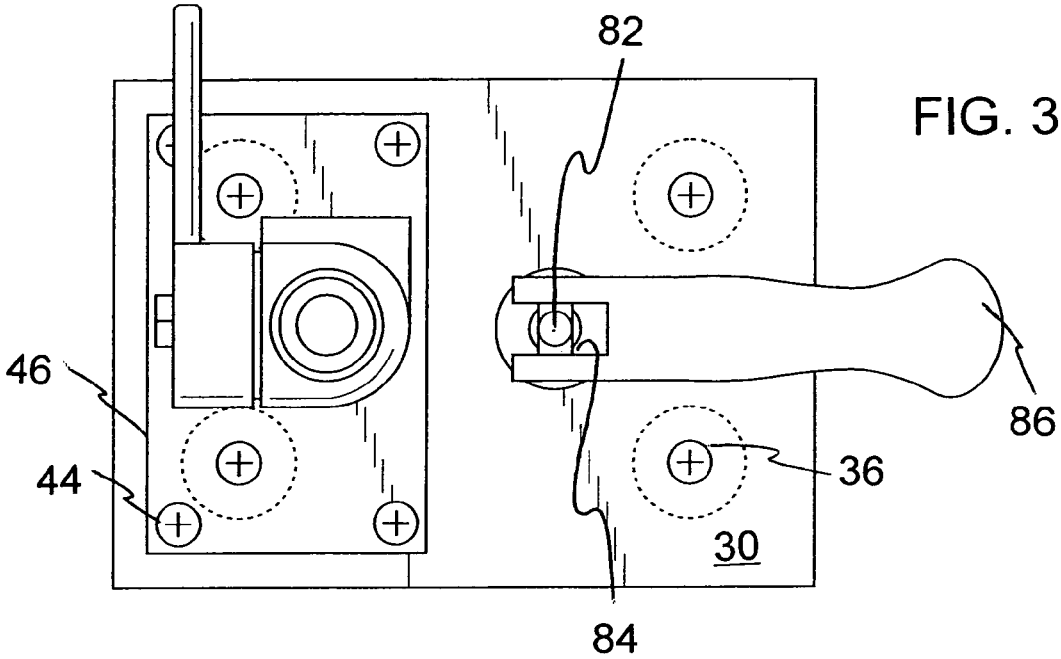
FIG. 3 is a plan view of the system shown in FIGS. 1 and 2.
Figure 4:
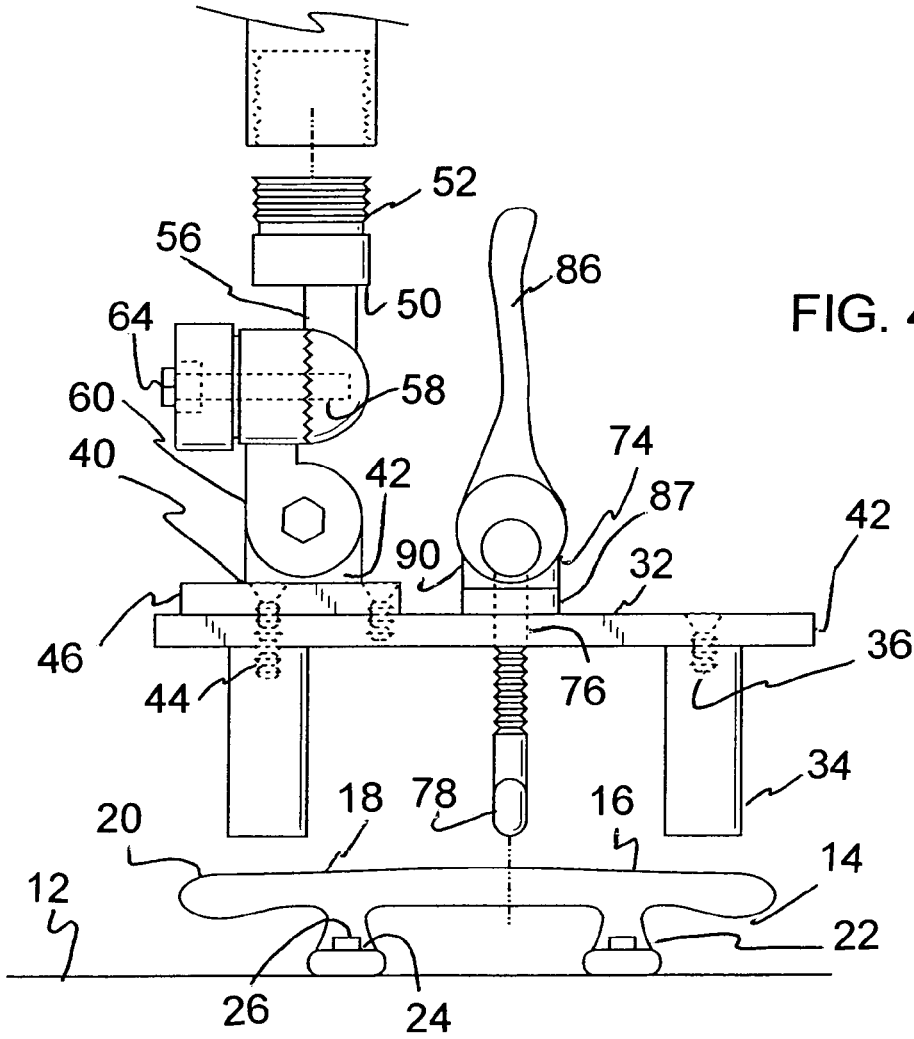
FIG. 4 is an exploded side elevational view similar to FIG. 1 but with the table, support hardware and coupling assembly separated from the cleat and the boat.

With reference now to the drawings, and in particular to FIG. 1 thereof, the preferred embodiment of the new and improved cleat clamp system embodying the principles and concepts of the present invention and generally designated by the reference numeral 10 will be described.

The present invention, the cleat clamp system 10 is comprised of a plurality of components. Such components in their broadest context include a table, support hardware and a locking assembly. Such components are individually configured and correlated with respect to each other so as to attain the desired objective.

First provided is a ship. The ship has an upper support surface 12. The upper support surface is in a horizontal plane. Attached to the support surface is a cleat 14. The cleat has a cross bar 16. The cross bar has a central section 18. The cross bar has end sections 20. The cross bar has laterally spaced support sections. The support sections are provided between the central and end sections. The cleat also has downwardly extending projections 22. The upper ends of the downwardly extending projections are formed integrally with the central sections. The lower ends of the downwardly extending projections are shaped to include apertures 24. Screws 26 are provided. The screws attach the cleat to the upper surface of the boat.

Provided next is a table 30. The table has a planar top panel 32. The table has an upper surface. The table has a lower surface. The table is in a rectangular configuration. The table has four downwardly extending legs 34. Each leg has an upper end. Each leg has a table bolt 36. The table bolt attaches the leg to the lower surface of the top panel. Each leg is provided in proximity to one corner of the lower surface of the top panel. The table is positioned on the upper surface of the boat. The central section of the cross bar is located between the legs and the ends sections of the cross bar. The central section of the cross bar extends beyond the legs.

Provided next is support hardware 40. The support hardware is attached to the upper surface of the top panel. The support hardware includes a base plate 42. The base plate is provided adjacent to one end of the upper surface above two of the legs. The support hardware includes four plate bolts 44. The plate bolts attach the plate to the top panel. The support hardware further includes a lower plate 46. The lower plate extends upwardly from the base plate. A horizontal threaded lower aperture 48 is provided perpendicular to the cross bar.

The support hardware also includes a terminal component 50. The terminal component has a threaded upper end 52. A fishing pole 54 is provided. The threaded upper end provides for the removable receipt of the fishing pole 54. The terminal component has an upper plate 56. The upper plate extends downwardly from the threaded upper end. A horizontal threaded upper aperture 58 is provided perpendicular to the threaded lower aperture.

The support hardware also includes an intermediate element 60. The intermediate element has an unthreaded lower aperture 62. The lower aperture is axially aligned with the threaded lower aperture. Mating radial teeth radiate from the lower apertures. The intermediate element has a lower coupling bolt 64. The intermediate element has a hexagonal recess. The hexagonal recess couples and uncouples the lower plate and intermediate element with the tightening and loosening of the lower coupling bolt. The intermediate element also has an unthreaded upper aperture 66. The upper aperture is axially aligned with the threaded upper aperture. Mating radial teeth radiate from the upper apertures. The intermediate element also has an upper coupling bolt 68. The upper coupling bolt couples and uncouples the terminal component and intermediate element with the tightening and loosening of the upper coupling bolt. The upper coupling bolt has a collar with a handle 70. In this manner the turning of the upper bolt is facilitated.

Provided last is a locking assembly 74. The locking assembly attaches and releases the table with the support hardware to the cleat and boat. The locking assembly includes an unthreaded hole 76 through the top panel of the table. A J-shaped hook 78 is formed with a lower arcuate section 80 adapted to be releasably positioned beneath the central section of the cross bar of the cleat and an upper threaded section 82 extending upwardly through the hole. A nut 84 threadedly receives the threaded section of the hook. A lever 86 is next provided. The lever supports the nut and the nut constitutes a pivot point for the lever. The locking assembly also includes a horizontal base plate 87 with an unthreaded aperture 88 for the hook and side plates 90 pivotally supporting the nut. The lever is adapted to pivot the cam in a first direction to raise the nut and hook to a locking orientation with the hook in secure engagement with the cleat. The locking assembly is adapted to be rotated about the axis of the upper portion of the bolt to raise and lower the hook with respect to the cleat for coupling and uncoupling purposes. The lever is adapted to pivot the cam in a second direction to lower the nut and hook to an unlocking orientation with the hook spaced from the cleat for separation purposes.

Figure 5:
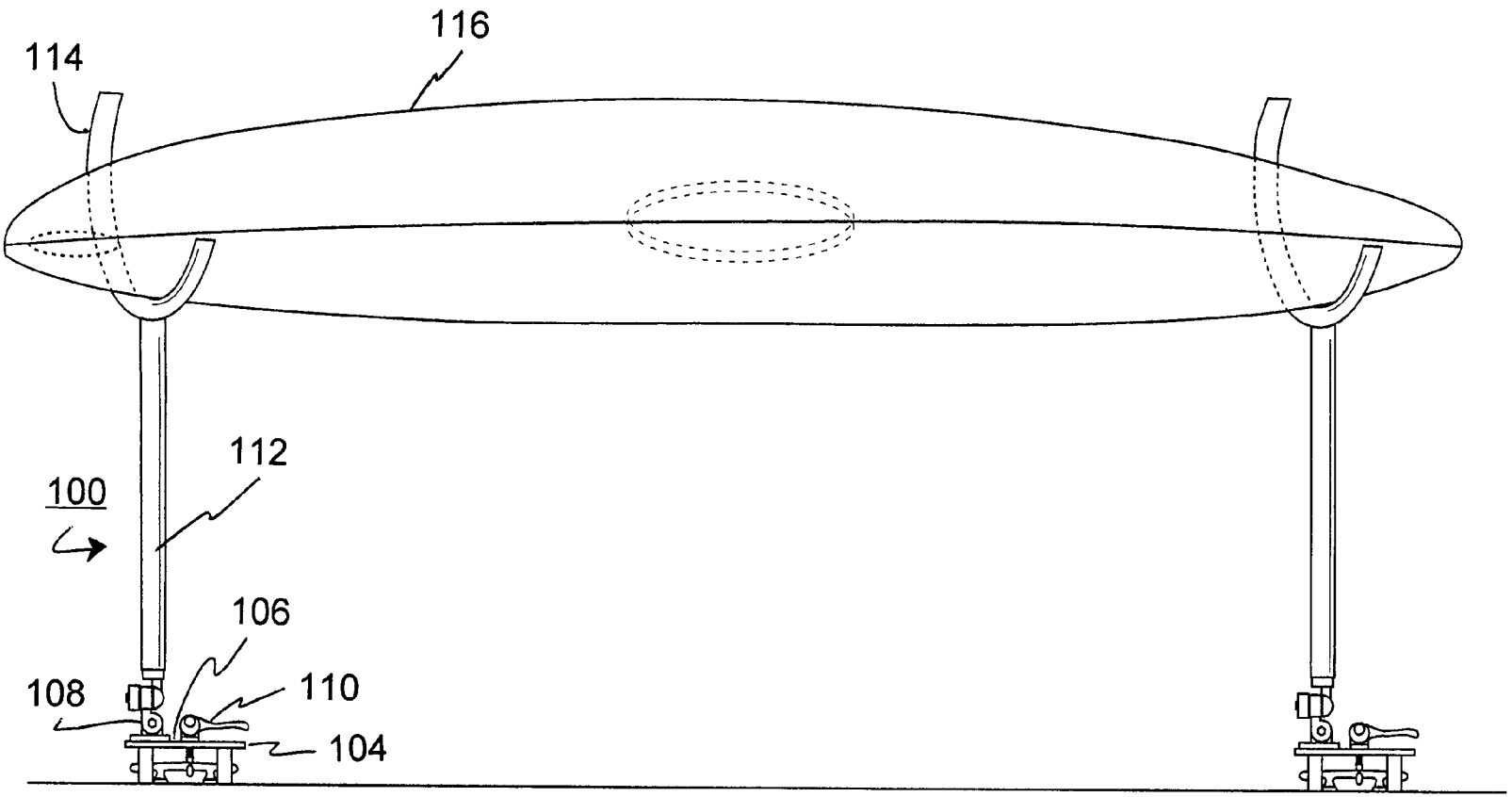
FIG. 5 is a side elevational view similar to FIG. 1 but illustrating an alternate embodiment of the invention.

Reference is now made to the alternate embodiment 100 of the invention as set forth in FIG. 5. A supplemental table 104 is provided. The supplemental table has a planar top panel 106. The supplemental table has downwardly extending legs. Each leg has an upper end. The upper end of each leg is attached to the top panel. Supplemental support hardware 108 is provided. The supplemental support hardware is attached to the upper surface of the top panel. A supplemental locking assembly 110 is also provided. The supplemental locking assembly attaches and releases the table with the support hardware to a cleat of a boat. The system further includes for each support hardware a vertical post 112. The vertical post has an arcuate upper end 114. A kayak 116 is provided. The upper ends of the vertical post are adapted to hold the kayak.

Figure 6:
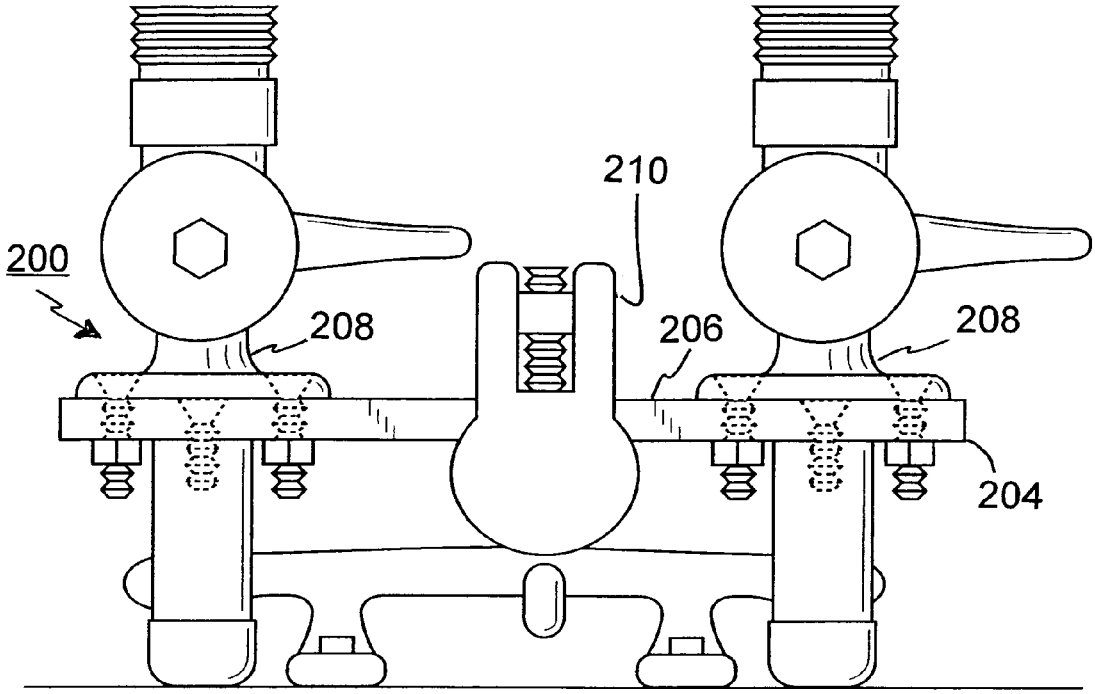
FIGS. 6 and 7 are side and end elevational views similar to FIGS. 1 and 2 but illustrating another alternate embodiment of the invention.
Figure 7:
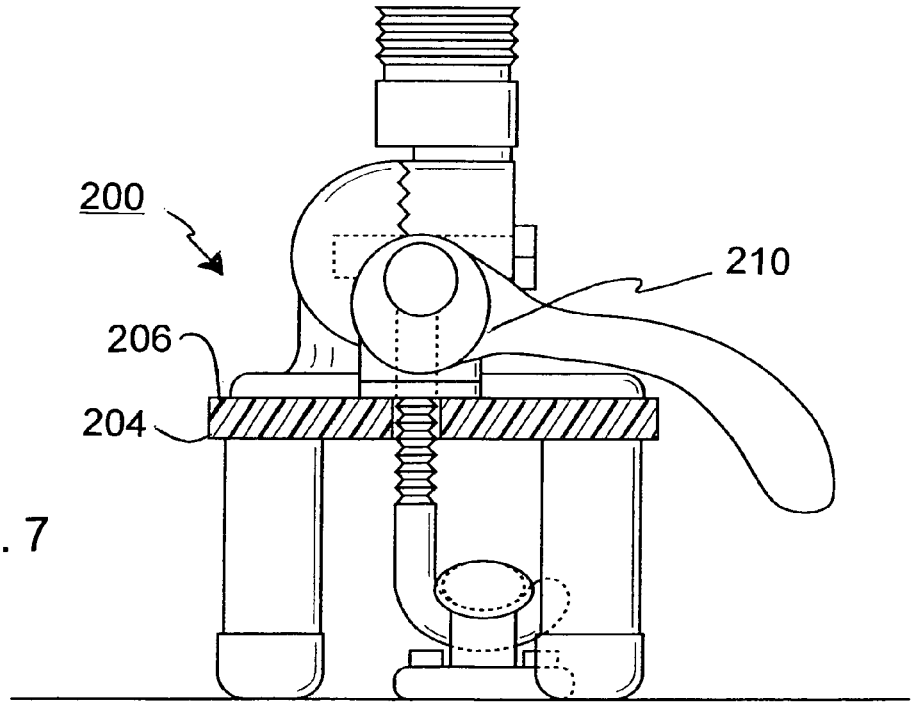

Reference is now made to the alternate embodiment 200 of the invention as set forth in FIGS. 6 and 7. A table 204 is provided. The table has an enlarged planar top panel 206. The table has downwardly extending legs. Each leg has an upper end. The upper end of each leg is attached to the top panel. Supplemental support hardware 208 is provided. The supplemental support hardware is attached to the upper surface of the top panel. A single locking assembly 210 is provided. The single locking assembly is provided between the support hardware. The locking assembly attaches and releases the table with the support hardware to a cleat of a boat.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cleat clamp system for removably coupling to a boat in a safe, reliable, convenient manner comprising, in combination:

a boat having an upper support surface in a horizontal plane with a cleat attached to the support surface, the cleat having a cross bar with a central section and end sections and laterally spaced support sections between the central and end sections, the cleat also having downwardly extending projections with upper ends formed integrally with the central sections and lower ends shaped to include apertures and with screws to attach the cleat to the upper surface of the boat;

a table having a planar top panel with an upper surface and a lower surface in a rectangular configuration and with four downwardly extending legs, each leg having an upper end with a table bolt attaching the leg to the lower surface of the top panel with each leg in proximity to one corner of the lower surface of the top panel, the table being positioned on the upper surface of the boat with the central section of the cross bar located between the legs and the ends sections of the cross bar extending beyond the legs;

support hardware attached to the upper surface of the top panel, the support hardware including a base plate adjacent to one end of the upper surface above two of the legs with four plate bolts attaching the plate to the top panel, a lower plate extending upwardly from the base plate with a horizontal threaded lower aperture perpendicular to the cross bar;

the support hardware also including a terminal component with a threaded upper end for removably receiving a fishing pole and an upper plate extending downwardly from the threaded upper end with a horizontal threaded upper aperture perpendicular to the threaded lower aperture;

the support hardware also including an intermediate element formed with an unthreaded lower aperture axially aligned with the threaded lower aperture and with mating radial teeth radiating from the lower apertures and with a lower coupling bolt to couple and uncouple the lower plate and intermediate element with the tightening and loosening of the lower coupling bolt, the intermediate element also formed with an unthreaded upper aperture axially aligned with the threaded upper aperture and with mating radial teeth radiating from the upper apertures and with an upper coupling bolt to couple and uncouple the terminal component and intermediate element with the tightening and loosening of the upper coupling bolt, the upper coupling bolt including a collar with a handle to facilitate the turning of the upper bolt; and a locking assembly for attaching and releasing the table and the support hardware to the cleat and the boat, the locking assembly including an unthreaded hole through the top panel of the table with a J-shaped hook formed with a lower arcuate section adapted to be releasably positioned beneath the central section of the cross bar of the cleat and an upper threaded section extending upwardly through the hole, a nut threadedly receiving the threaded section of the hook, a lever supports the nut and the nut constituting a pivot point for the lever, the locking assembly also including a horizontal base plate with an unthreaded aperture for the hook and side plates pivotally supporting the nut, the lever adapted to pivot the cam in a first direction to raise the nut and hook to a locking orientation with the hook in secure engagement with the cleat, the lever adapted to pivot the cam in a second direction to lower the nut and hook to an unlocking orientation with the hook spaced from the cleat for separation purposes.

* * * * *